US005179753A

United States Patent [19]

Flaherty et al.

[11] Patent Number: 5,179,753

[45] Date of Patent: Jan. 19, 1993

[54] JET THRUSTER WITH SPINNER HEAD

[76] Inventors: William J. Flaherty; Matthew J. Flaherty, both of 2536 East St., Davenport, Iowa 52803

[21] Appl. No.: 838,998

[22] Filed: Feb. 21, 1992

Related U.S. Application Data

[63] Continuation-in-part of Ser. No. 758,132, Sep. 12, 1991, abandoned.

[51] Int. Cl.[5] ..... B08B 9/02

[52] U.S. Cl. ..... 15/104.12; 134/167 C

[58] Field of Search ..... 15/104.12; 134/166 C, 134/167 C, 168 C, 169 C

[56] References Cited

U.S. PATENT DOCUMENTS

| | | | |
|---|---|---|---|
| 1,426,919 | 8/1922 | Sladden | 15/104.12 |
| 1,448,878 | 3/1923 | Sladden | 134/167 C |
| 3,844,362 | 10/1974 | Elbert et al. | 15/104.12 |
| 4,819,314 | 4/1989 | Shaddock | 134/167 C |

FOREIGN PATENT DOCUMENTS

| | | | |
|---|---|---|---|
| 2906382 | 8/1980 | Fed. Rep. of Germany | 134/167 C |
| 8501521 | 12/1986 | Netherlands | 134/167 C |
| 419272 | 8/1974 | U.S.S.R. | 15/104.12 |
| 578128 | 10/1977 | U.S.S.R. | 134/167 C |
| 8912513 | 12/1989 | World Int. Prop. O. | 15/104.12 |

*Primary Examiner*—Edward L. Roberts
*Attorney, Agent, or Firm*—Henderson & Sturm

[57] ABSTRACT

A jet thruster for attachment to the outlet end of a high-liquid-pressure hose for use, among other things, in clearing drain lines or the like. The jet thruster comprises a body formed of at least hemi-spherical shape about a fore-and-aft axis that is substantially an extension of the hose. The hemi-spherical shape gives the frontal area of rearwardly and radially outwardly sloping configuration over which liquid jets stream in close proximity to that area to augment the forward thrust action against the walls of the drain line which facilitates advance of the thruster through the drain line. Ahead of the frontal area a spinner head is coaxially journalled for rotation via thrust exerted by liquid existing laterally from another jet in the spinner head. The spinner head jet(s) further create forces that are utilized for clearing the drain line of sludge, roots and the like. Further, the spinner head may carry blades or the like for increasing the clearing action of the thruster.

20 Claims, 4 Drawing Sheets

Fig. 1
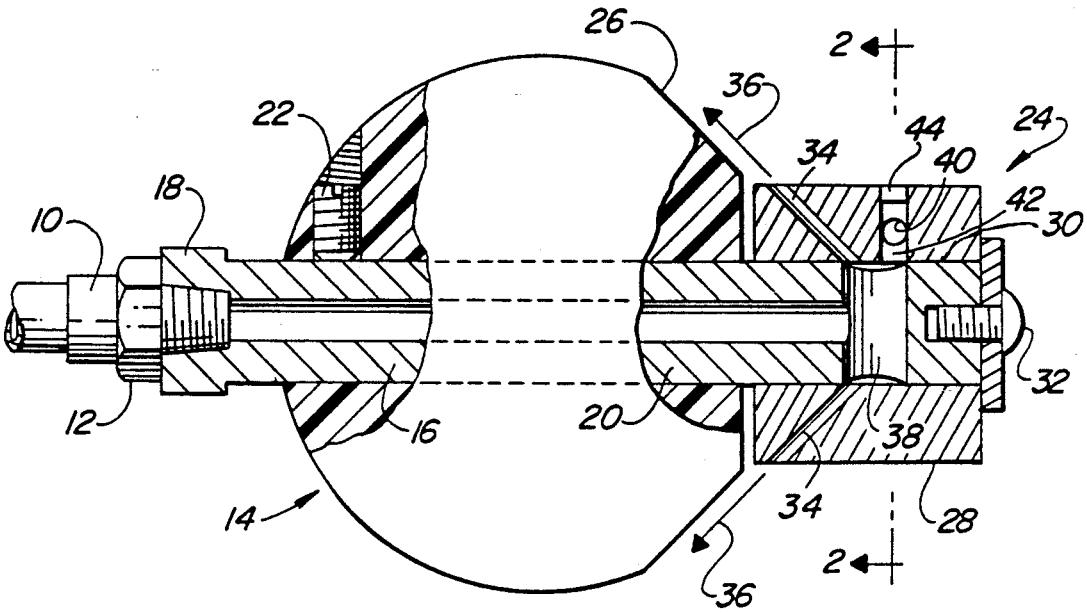
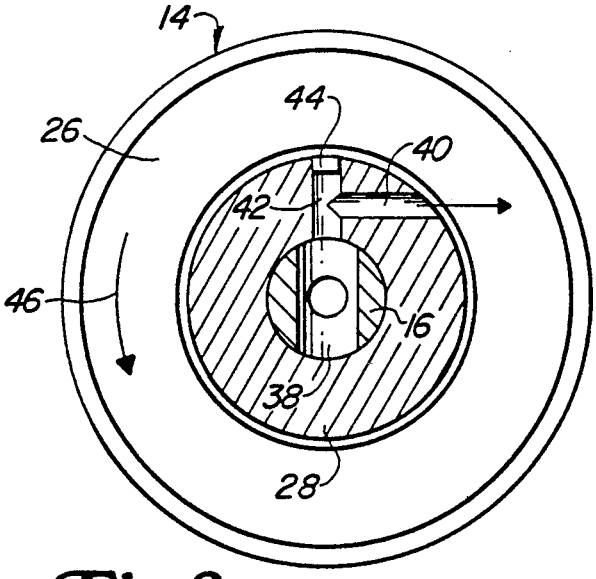
Fig. 2

Fig. 11
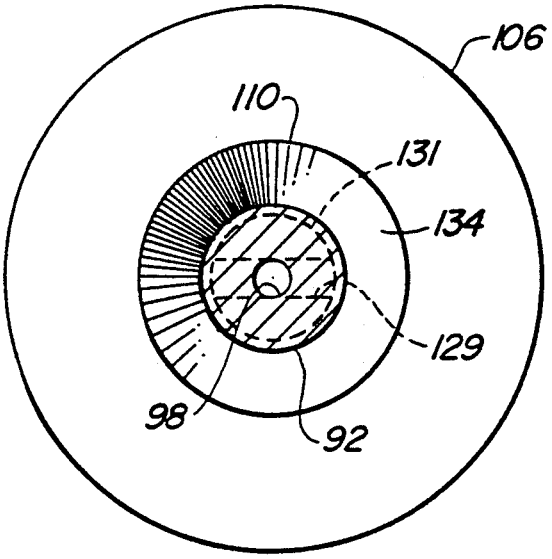
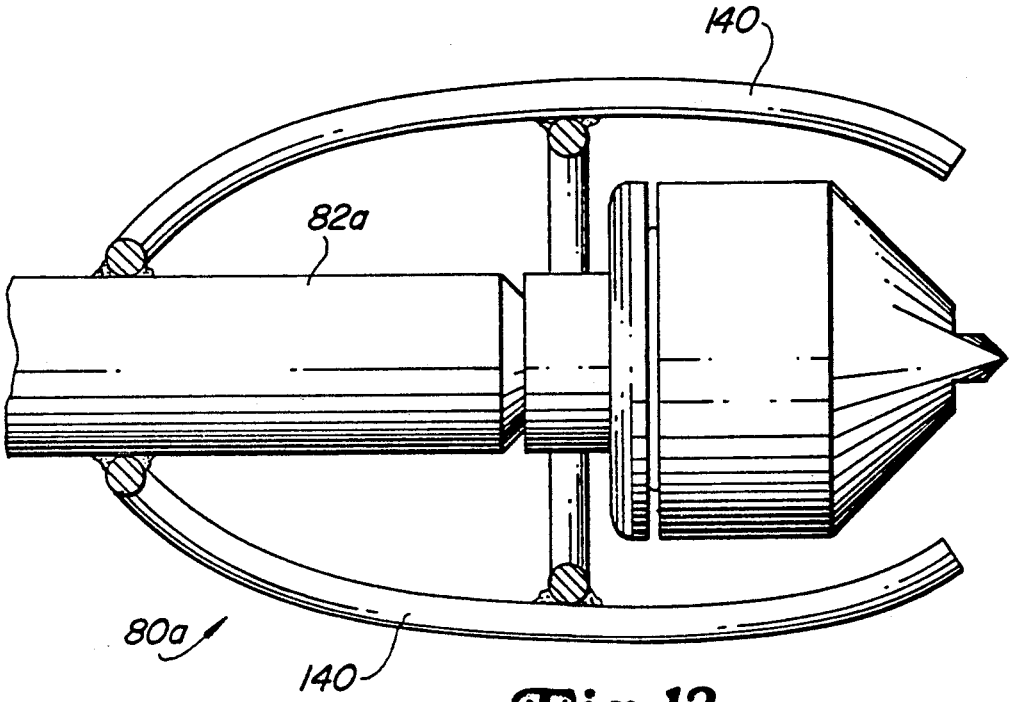
Fig. 12

JET THRUSTER WITH SPINNER HEAD

This application is a continuation-in-part of U.S. application Ser. No. 07/758,132 filed Sep. 12, 1991 now abandoned.

BACKGROUND AND SUMMARY OF THE INVENTION

It is known to clear drain lines and the like of accumulated obstructions by the use of high-pressure water carried by a hose inserted into the line. Such prior uses utilize jets aimed rearwardly to aid in advancing the hose through the line. Prior apparatuses are characterized by low efficiency and relatively high costs. Attempts to improve jet-powered machines include water-motor cutters for cases where the drain line may be clogged by roots, for example, but such water-motors are even more costly and difficult to operate.

According the present invention, an improved thruster is provided, eliminating the need for mechanical or water vane motor driving means and instead relying on properly placed jet means not only to assist in advance of the thruster but to create a rotary action particularly effective for cutting roots and the like in the drain line. The invention in one form features a thruster having a body of at least hemi-spherical configuration about a fore-and-aft axis, the front part of the body providing an annular frontal area of rearwardly and radially outwardly sloped disposition. A coaxial forward extension of the body is provided with a jet means aimed to direct high-pressure water closely over the frontal area to combine a thrusting action with the effects of vacuum or low-pressure to augment the advance of the thruster through a drain line or comparable environment. In one form of the invention, the forward extension is cylindrical and journals a spinner head which is rotated by additional jet means configured to act on the spinner head in such a manner as to drive the spinner head. The spinner head may also carry blade or whip-like elements to facilitate the use of the thruster in extreme situations, as where the drain line has been penetrated by tree roots.

A further feature of the invention is that the thruster body is carried by means providing for selective fore-and-aft positioning thereof relative to the jets so as to vary the relationship between the frontal area of the body and the jets. Still further, provision is made for adjusting the sizes of the rearwardly directed jet means. Yet another feature is the provision of cooperative frusto-conical portions of the thrusters to form fan jet means, and further to make axial adjustment of those portions to vary the size of the fan jet means.

The foregoing and other features and advantages of the invention will become apparent as the invention is disclosed in the ensuing description and accompanying drawings.

DESCRIPTION OF THE DRAWINGS

FIG. 1 is a side view of one form of the improved thruster, shown partly in section so as to expose interior features.

FIG. 2 is a section on the line 2—2 of FIG. 1.

FIG. 11 is a section on the lines 11—11 of FIG. 10.

FIG. 12 shows a further form of the invention adding skids in place of the spherical body of FIG. 8.

DETAILED DESCRIPTION OF PREFERRED EMBODIMENT OF THE INVENTION

Figure 3:
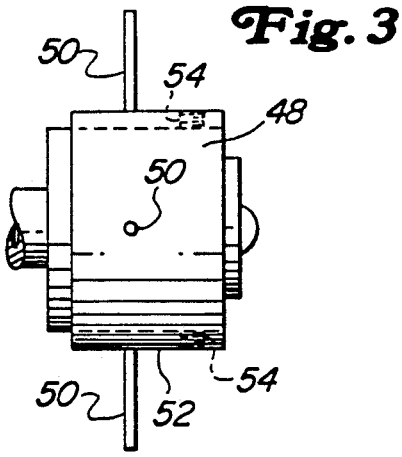
FIG. 3 is a form of spinner head equipped with blade- or whip-like cutting elements.

Reference is had primarily to FIG. 1 and 2, along with the assumption that those skilled in the art are familiar with use of high-pressure liquids (water) for cleaning drain lines and the like.

The number 10 indicates a typical high-pressure hose having an outlet end 12 connected to thruster body generally designated at 14. This body is essentially spherical and the front hemi-spherical portion is significant, as will presently appear. The body may be of any suitable material, such as any known light-weight plastic so that the body may "float" in the water-logged stopped-up drain line. An elongated fore-and-aft tubular member 16 extends axially through the body, forming passage means through the body. The member 16 has a rear end 18 internally threaded for suitable communicative connection to the outlet end of the hose 10, and the tubular member further has a front end 20 that in effect provides a coaxial forward extension of the body. The tubular member is longer than the fore-and-aft dimension of the body and provides for selective fore-and-aft positioning of the body on the member. Locking means in the form of a set screw 22 enables fixing of selected position of the body.

The front part of the body further carries reduced-diameter means 24 for directing water under pressure rearwardly and outwardly over the body in a manner to be presently described. The hemi-spherical configuration of the front of the body is preferably modified to provide an annular frontal area in the form of a frusto-conical band or margin 26. The front means 24 includes a spinner head 28 journalled on the front extension 20 of the tubular member, which is of cylindrical section to afford a bearing 30 for this purpose. Water leakage provides lubrication for the bearings. A washer and cap screw unit retains the spinner head in place.

The spinner head is provided with a plurality of jets 34 which are sloped rearwardly and radially outwardly to direct high-pressure water closely over the frontal area 26 of the body, as shown by the arrows 36, creating a low-pressure zone which augments the advance of the thruster. The jets 34 communicate with the interior passage of the tubular member 16 via a cross bore 38 in that member. As previously noted, the body 14 is selectively positionable on the tubular member to vary the relationship of the frontal area to the jets 34.

Figure 4:
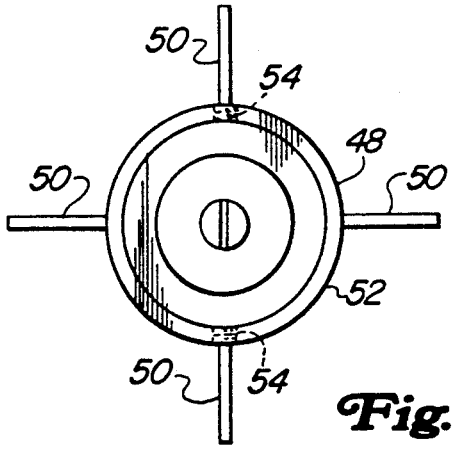
FIG. 4 is a front view of FIG. 3.
Figure 5:
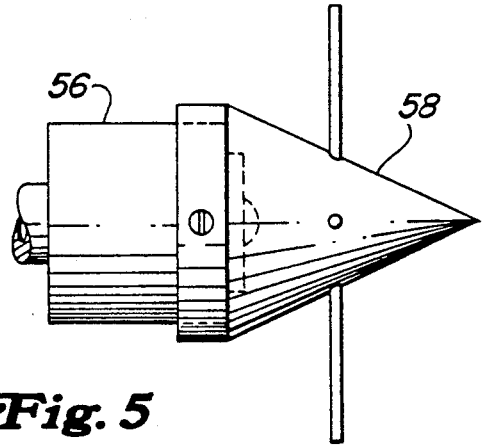
FIG. 5 shows the spinner head equipped with a conical element to augment advance of the thruster.

The spinner head is rotatable on the tubular member front bearing 30 by lateral thrust created by a non-radial cross jet 40 which connects to the central passage in the member 16 via a radial bore 42 plugged at 44. The high-pressure stream projected via the jet 40 acts on the walls of the drain line (not shown) to drive the spinner head in the direction of the arrow 46 (FIG. 2). The jet action also acts to clear blockage in the drain line. This function may be augmented by providing a modified spinner head 48 which carries a plurality of beaters such as blade or whip-like elements 50 (FIGS. 3 and 4). This means may include a sleeve 52 held to the spinner head via set screws 54. Many other forms of this modification will suggest themselves. FIG. 5 shows a further variation in which a spinner head 56 carries a conical member 58 as an aid in penetrating drain line blockage. Obviously, the cone of FIG. 5 and the cutters of FIGS. 3 and 4 may be combined. It is understood, of course, that the spinner heads are rotatable as described in connection with FIGS. 1 and 2.

Figure 6:
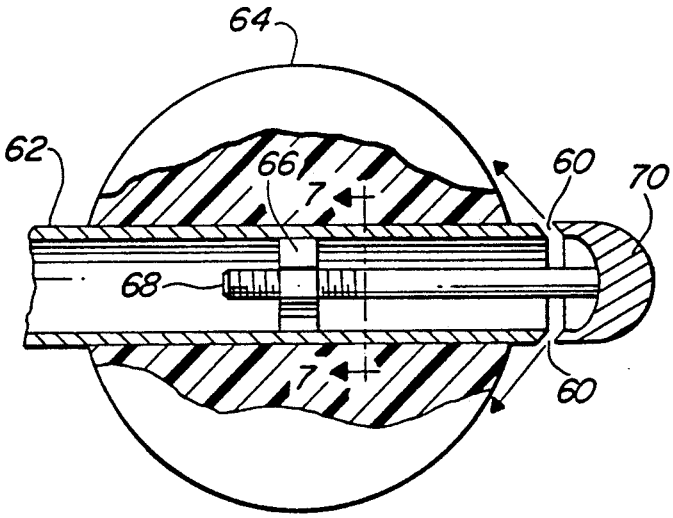
FIG. 6 is a form of the invention, shown partly in section, in which the rearwardly directed jets or one fan jet are adjustable.
Figure 7:
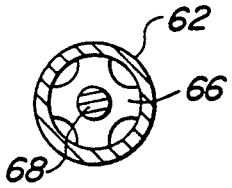
FIG. 7 is a section on the line 7—7 of FIG. 6.

FIGS. 6 and 7 show a modification without the spinner head in which forward jets 60 are provided in a tubular member 62 that carries a body 64. Within the tubular member is fixed an internally threaded star-shaped nut 66 into which is threaded a screw 68 terminating in a forward knob 70 which forms part of the jets 60. The knob may be screwed in or out to vary the sizes of the jets, or one annulus which will create a fan effect, which act, of course, on the frontal area of the body.

In that form of the invention illustrated in FIGS. 8–11, a body is designated generally at 80 as including a central part 82 having a typical connection 84 to the front or outlet end of a high-liquid-pressure hose 86, generally along the lines of the structure previously described, the body part 82 thus serving as a forward, coaxial extension or prolongation of the hose. The body further includes a spherical member or ball 88 like that earlier described, the mounting of the element on the body part being such that the two are relatively axially adjustable, and selected positions of adjustment are secured by locking means such as a set screw 90.

The body further includes a forward extension means 92, here in the form of an elongated coaxial shoulder bolt or cap screw or the like having a rear end threaded at 94 into the forward threaded end of a fore-and-aft passage means 96 in the body part 82. The extension means 92 is itself formed with a passage means 98 as a coaxial prolongation of the passage means 96. The rear end of the extension means 92 is received in a counterbore 100 at the front end of the passage means 96 and suitable seals 102 are used at this junction. The forward part of the extension means 92 is formed as a cylindrical bearing surface 104 and a spinner head 106 is rotatable on this surface. The spinner head is made up of front and rear parts 108 and 110 threaded together at 112, the connection being suitably sealed at 114. The front spinner head part 108 is conical and has a pair of flats 116 for receiving a wrench or like tool. The nature or configuration of the spinner head is such that it includes a pocket or hollow interior 118 which accommodates an enlarged front end or cap 120 on the extension means 92. A thrust bearing 122 functions between the rear end of the cap 120 and the interior wall of the rear part 110 of the spinner head. This, plus the bearing at 104 assures free rotation of the spinner head via a lateral thrust created by a jet means 124 which receives water under pressure through the passage means 96 and 98 which communicate with the spinner head pocket 118 at 126.

A further jet means is provided at 128 for directing high-pressure fluid rearwardly and radially outwardly over the frontal area 130 of the spherical body part 88. Compare jet means 34 and area 26 in FIG. 1. In the case of the jet means 128, however, a fan jet or high-pressure spray results from the configuration of the means 128 as existing at least in part in the spinner head 106 and in part in the front or terminal end 132 of the tubular body part 82, which terminal end is formed as an annulus of frusto-conical configuration which complements the rear terminal end 134 of the spinner head rear part 110. An arrow 136 represents in general the direction of the fan jet from 128, it being understood that the jet is annular about the basic fore-and-aft of the structure. The jet means is supplied with high-pressure fluid via cross passage means 129 in communication with an annular groove 131 in the extension means 92. Further, the size of the jet means 128 is selectively adjustable by threading the cap screw or shoulder bolt 92 inwardly or outwardly at 94, which of course, varies the gap between the complementary frusto-conical portions 132 and 134. The selected adjusted position is retained by locking means such as a set screw 138. This screw may be axially ahead of the ball 88 for easy access, or the rear set screw 90 may be temporarily released to enable rearward positioning of ball to improve access to the set screw 138. Access to the shoulder bolt 92 is had removal of the front part 108 of the spinner head from the spinner head rear part 110. The front part is of course replaced after all adjustments are secured.

FIG. 12 illustrates a further modification in which a body structure **80*a* is provided with skids 140 running lengthwise and equally angularly spaced about the tubular body part 82*a* by means of being fixed, as by welding at 142 to a coaxial ring 144 and a rear portion of the part 82*a***. The skids serve to guide the structure through a drain line or the like.

Figure 8:
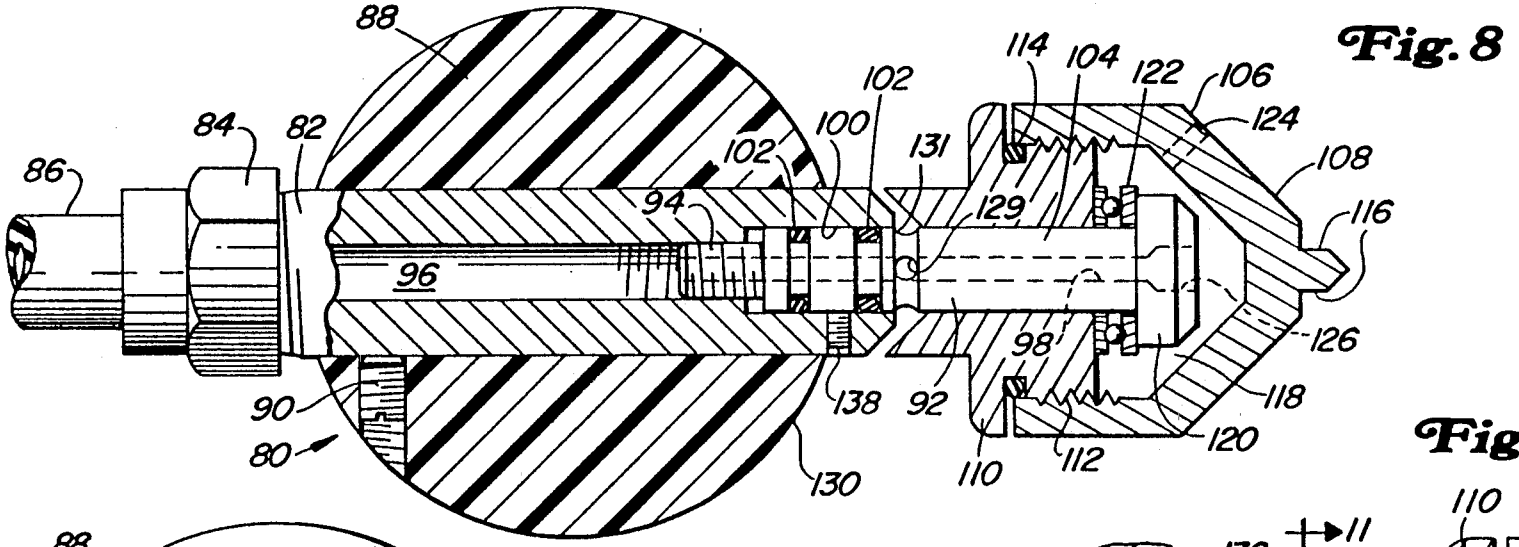
FIG. 8 is a longitudinal sectional view of another form of the invention involving fan jet means.
Figure 10:
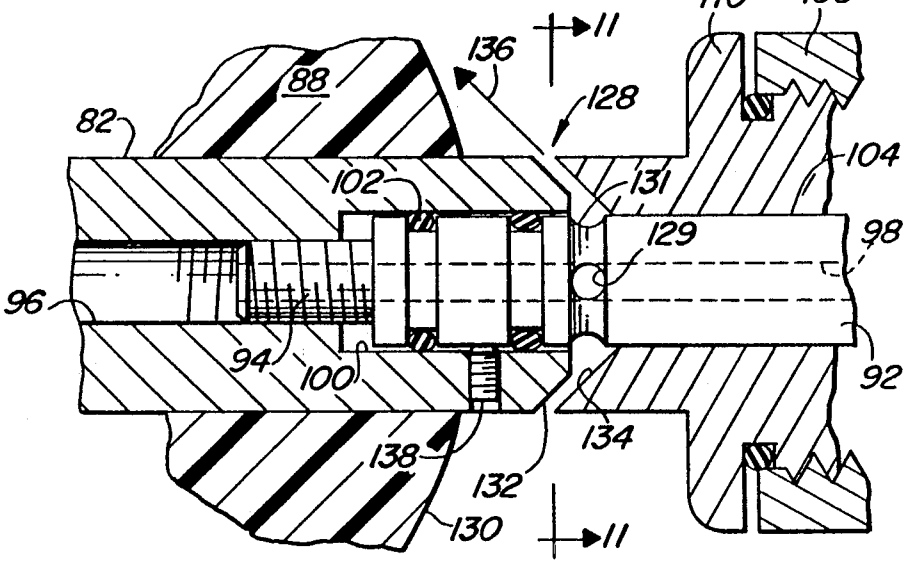
FIG. 10 is an enlarged fragmentary view showing the fan jet means.
Figure 9:
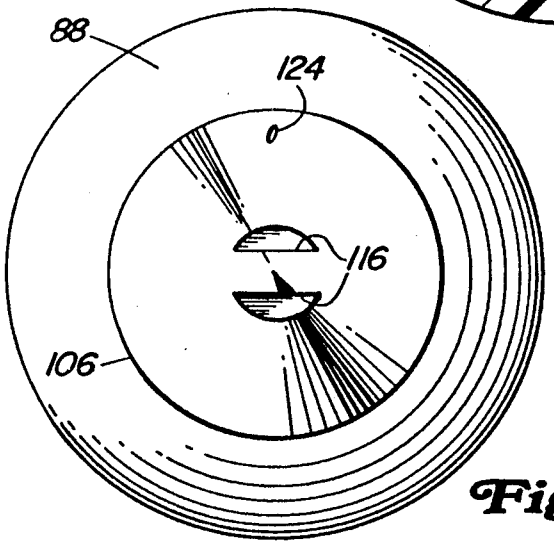
FIG. 9 is an end view of same.

It will be clear that several of the components among the drawing figures are similar in structure, function and result, all of which is believed to be self-explanatory and needs no repetitious numbering of the various parts. Among the features overall are controlled leakage of high-pressure fluid at significant areas which lubricates plain bearings and thus eliminates the need for costly mechanical bearings. Some of these areas are seen at the means 32 in FIG. 1 which holds the spinner head on its bearing surface on the member 20, as well as at the bearing surface itself, and also at the interface between the spinner head and the front of the ball 14. In FIG. 8, similar areas will be seen at the bearing surface 104, thrust bearing 122 and jet means 128, especially in the latter case in which the fan jet provides for axial "float" of the spinner head relative to the body part extension means 92.

It will be seen from the foregoing that a novel thruster has been provided, of simple design adapted for low-cost manufacture and easy use. Features and advantages other than those pointed out will readily occur to those versed in the art, as will many modifications and variations in the preferred forms of the invention disclosed, all without departure from the spirit and scope of the invention.

We claim:

1. A jet thruster for attachment to the front end of a high-liquid-pressure hose, comprising a body providing substantially a coaxial forward prolongation of the hose, said body having a coaxially forward extension means provided with a coaxial cylindrical bearing surface, said body and extension means including fore-and-aft passage means therethrough for communicative connection to the outlet end of the hose, a spinner head rotatable on the cylindrical bearing surface, first jet means in communication with the aforesaid passage means and contained at least in part in the spinner head and exiting rearwardly and radially outwardly to direct liquid under pressure over the body so as to create a thrust force tending to advance the body and second jet means in the spinner head and in communication with the passage means and extending in non radial relation to the spinner head and exiting outwardly in such manner as to create a side thrust tending to rotate the spinner head.

2. The invention according to claim 1, in which the body has a radially enlarged rearwardly sloping frontal area just rearwardly of the spinner head and the first jet means, discharges closely rearwardly over said area.

3. The invention according to claim 2, in which the fore-and-aft extension is a tubular member separate from the body and the body is selectively positionable fore-and-aft on the tubular member for changing the relationship of its frontal area to the jet means, and locking means is provided for securing selected positions of the body.

4. The invention according to claim 3, in which the forward portion of the body includes an annular band of frusto-conical section forming the frontal area.

5. The invention according to claim 1, including means on the spinner head for facilitating forward movement of the jet thruster through a drain line.

6. The invention according to claim 5 in which said means on the spinner head includes a coaxial conical forward extension having its apex pointing forwardly.

7. The invention according to claim 5, in which said means on the spinner head includes a plurality of generally radially extending blade-like elements.

8. The invention according to claim 1, in which the body includes an elongated tubular portion containing part of the passage means and a radially enlarged outward part axially slidable fore-and-aft on the tubular portion and having a frontal area just rearwardly of the spinner head, the first jet means discharges rearwardly over said area, and releasable securing means is cooperative between the tubular portion and the enlarged part of selectively fixing the axial position of said part relative to the tubular portion.

9. The invention according to claim 1, in which the extension means is separate from and is carried by the body and part of the first jet means is provided in the extension means.

10. The invention according to claim 9, in which the extension means has a forward radial thrust portion radially larger than the cylindrical bearing surface on the extension means and the spinner head has an internal cylindrical bearing portion journalled on the extension means cylindrical bearing surface and further has a radial thrust bearing cooperative with the radial thrust portion of the extension means.

11. The invention according to claim 9, in which the extension means is axially adjustable relative to the body.

12. The invention according to claim in which means is cooperative between the body and extension means for selectively fixing the position of the extension means relative to the body.

13. The invention according to claim 1, in which the spinner head has a coaxial rear frusto-conical portion sloping rearwardly and radially outwardly and the body has a complementary similar frusto-conical portion spaced just rearwardly of the spinner head portion, the two portions cooperating to provide the aforesaid first jet means whereby said first jet means is operative as a fan.

14. The invention according to claim 13, in which the spinner head is fore-and-aft adjustable relative to the body so as to vary the spacing between the frusto-conical portions and thereby to vary the size of the first jet means.

15. The invention according to claim 1, in which the body has a terminal front end that terminates in a coaxial rearwardly and radially outwardly directed frusto-conical portion, the extension means projects axially ahead of terminal end and journals the spinner head, and the spinner head has a terminal rear end formed as a frusto-conical portion spaced ahead of and complementing the body terminal front end to provide the first jet means as a fan jet.

16. The invention according to claim 1, in which the body and extension means are axially separate parts, each containing a portion of the fore-and-aft passage means, the body has a terminal front end provided with a counterbore coaxial with its passage means portions, the extension means has a rear portion coaxially received in the counterbore, the body and extension means are coaxially threaded together, seal means is provided between the rear portion of the extension means and the counterbore, and, locking means is cooperative between the body and extension means to prevent unthreading of one from the other.

17. The invention according to claim 1, including means on the body and extending radially outwardly therefrom for guiding the body through a drain line.

18. The invention according to claim 17, in which said means is a plurality of fore-and-aft skids.

19. The invention according to claim 1, in which the first jet means is configured to produce a fan in the form of an annular about the fore-and-aft axis of the body.

20. The invention according to claim 19, in which the configuration of the first jet means is such that the fan is frusto-conical.

* * * * *